US007172100B2

(12) United States Patent
Mertens

(10) Patent No.: US 7,172,100 B2
(45) Date of Patent: Feb. 6, 2007

(54) PLASTIC INSERT MEMBER FOR CONNECTING TO A CONTAINER MEMBER

(75) Inventor: Frank Mertens, Finnentrop-Heggen (DE)

(73) Assignee: Georg Menshen GmbH & Co., KG, Finnentrop (DE)

( * ) Notice: Subject to any disclaimer, the term of this patent is extended or adjusted under 35 U.S.C. 154(b) by 442 days.

(21) Appl. No.: 10/843,623

(22) Filed: May 12, 2004

(65) Prior Publication Data

US 2004/0206777 A1 Oct. 21, 2004

Related U.S. Application Data

(63) Continuation of application No. PCT/EP02/12664, filed on Nov. 12, 2002.

(30) Foreign Application Priority Data

Nov. 14, 2001 (DE) ..... 201 18 578 U

(51) Int. Cl.
*B65D 47/00* (2006.01)

(52) U.S. Cl. ..... 222/547

(58) Field of Classification Search ..... 222/547, 222/564, 534, 529
See application file for complete search history.

(56) References Cited

U.S. PATENT DOCUMENTS 3,223,298 A * 12/1965 Roberson et al. ..... 222/547
4,732,299 A 3/1988 Hoyt
5,823,383 A 10/1998 Hins
6,065,651 A 5/2000 Tedeschi, Jr. et al.
6,241,132 B1 6/2001 Morrison

* cited by examiner

*Primary Examiner*—Philippe Derakshani
(74) *Attorney, Agent, or Firm*—Sughrue Mion, PLLC

(57) ABSTRACT

A plastic insert member includes a base body containing a through passage, said through passage having opposite axial opening ends, at least one connecting rib projecting from the outer periphery of the base body for connecting the insert member to a container member, and distributor means formed on the base body adjacent one of the axial opening ends of the through passage for transversely deflecting at least a portion of a flow of fluid emerging from said one opening end. The distributor means comprise at least a single distributor bar transversely bridging over said one opening end in spaced relationship therefrom, said distributor bar being movable between a position bridging over said one opening end of the through passage and a position in which it does not bridge over said one opening end of the through passage. Preferably a barrier wall extends across the through passage at an axial portion thereof intermediate the axial opening ends thereof and is integrally connected with the base body through a weakening means adapted to rupture under an axial force exerted on the barrier wall.

10 Claims, 1 Drawing Sheet

PLASTIC INSERT MEMBER FOR CONNECTING TO A CONTAINER MEMBER

The following disclosure is based on the international patent application No. PCT/EP02/12664, filed on Nov. 12, 2002, with the designation of USA, of which the present application is a Continuation, and the German utility model application No. 20118578.4, filed on Nov. 14, 2001, which are incorporated into the present application by reference.

FIELD OF AND BACKGROUND OF THE INVENTION

The present invention relates to a plastic insert member for inserting into an opening of a container member and for connecting thereto.

The invention relates in particular to dimensionally stable plastic insert members for welding to a container member formed of flexible plastic foil material for producing flexible pouches such as are used in dispensing machines for storing e.g. powdery products such as coffee or tea granules, which are solvable in a fluid such as water. Here, a quantity of fluid is directed into the pouch through the insert member, e.g. hot water is directed into the interior of the pouch so as to dissolve the powder and produce a drink which can be extracted through the insert member for further use. For uniformly distributing the flow of fluid to every portion of the interior of the pouch whilst simultaneously avoiding powder residues which are not dissolved in the pouch, it has already been proposed to provide a distributor bar in the flow path of the fluid near the outlet opening of a through passage in the insert member so that the fluid flow will strike the bar and thus be deflected to the sides. One disadvantage of this arrangement is that restrictions are associated therewith in regard to the design of a barrier seal wall for hermetically sealing the through passage until the time the pouch is used. In the known arrangements, the barrier wall consists of a barrier foil that can be perforated by means of a spike or the like. This barrier wall requires an additional manufacturing step for the insertion and mounting thereof in the through passage. Another disadvantage is that the insert member is dedicated to the production of such a flow-deflecting effect even though it may be desirable in many applications of use, without the need for producing and storing another type of pouch for this purpose, for the fluid to be introduced into the interior of the pouch without deflecting its direction of flow.

OBJECTS OF THE INVENTION

An object of the present invention is to provide an improved insert member of the type in question. A specific object of the present invention is to provide an insert member of the type in question which, even when provided with a barrier wall, can be produced in one piece in one manufacturing step and which will permit usage either with or without flow deflection.

SUMMARY OF THE INVENTION

These and other objects are solved in accordance with the present invention by a plastic insert member, including a base body containing a through passage, said through passage having opposite axial opening ends, connecting means for connecting said plastic insert member to a container member, and distributor means formed on the base body adjacent one of the axial opening ends of the through passage in spaced relationship therefrom for deflecting at least a portion of a flow of fluid emerging from said one opening end, said distributor means being movable between a position in which it extends across said one opening end of the through passage and a position in which it does not extend across said one opening end of the through passage.

In the insert member according to the present invention the position of a distributor bar providing for lateral spreading of a flow of fluid impinging thereon is not unalterably fixed, but rather, it is variable in that the distributor bar can be pivoted between a position in which it bridges over an adjacent opening end of the through passage of the insert member in spaced relationship thereto, and a non-bridging position. In the latter position, the distributor bar is ineffective since it forms but a quasi axial extension of the base body of the insert member. Consequently, in this position, a barrier wall, which is often desired for hermetically sealing the through passage can be formed by moulding operation on the base body. The barrier wall which may be connected to through passage by the means of weakened portion, can be removed from the insert member under the effect of an external axial force exerted thereon for causing rupture of the weakened portion. The barrier wall thereby replaces a barrier foil hitherto used for sealing the through passage, but which had to be formed and mounted in independent costly manufacturing steps.

BRIEF DESCRIPTION OF THE DRAWING

The invention will be explained in more detail hereinafter with reference to the drawing showing an embodiment thereof. In the drawing.

DETAILED DESCRIPTION OF A PREFERRED EMBODIMENT

Figure 1:
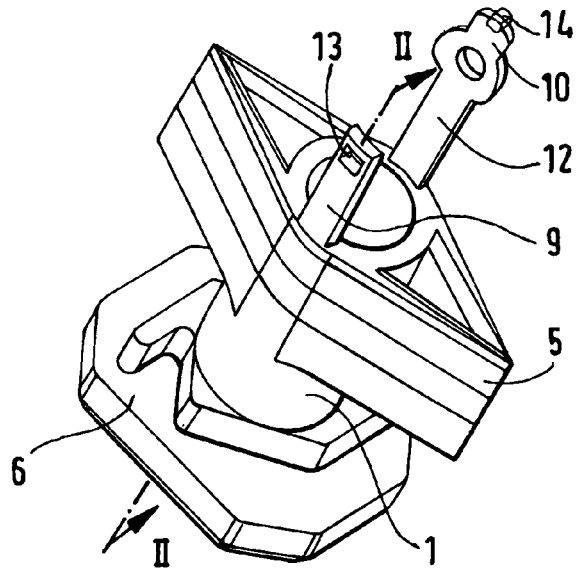
FIG. 1 is a perspective view of an insert member according to the invention, formed as a weld pourer member.

A preferred embodiment of the invention will now be explained in more detail with reference to the drawing.

Although the invention will be described hereinafter in connection with a plastic insert member in the form of a weld pourer member, it should be understood that for connecting the insert member and a container member (not shown) with each other techniques than by welding can be used, e.g. by means of an adhesive, heat sealing and the like. The container member preferably consists of a foil-like material. The insert member is introduced into a slit-like opening in the container member and is permanently connected thereto in a subsequent step. Suitable manufacturing steps and connecting techniques are known to the skilled person and thus do not need to be explained in detail here.

With reference to FIG. 1, the weld pourer member comprises a tubular base body 1 having one or more welding ribs 5 formed on its outer periphery. The ribs have a profiled configuration which is suitable for connecting the weld pourer member to a container member (not shown). In particular, the welding ribs 5 may be formed as shown in the WO96/38349 to which reference may thus be made for further details.

The welding ribs 5 are provided adjacent one of the axial ends of the base body 1. Close to the other axial end of the base body 1, there is provided a mounting formation 6 with the aid of which the weld pourer member can be mounted on an equipment e.g. a drinks dispenser. The shape of the mounting formation 6 is of minor importance to the present invention so that there is no need to go into more detail in respect thereof.

Figure 3:
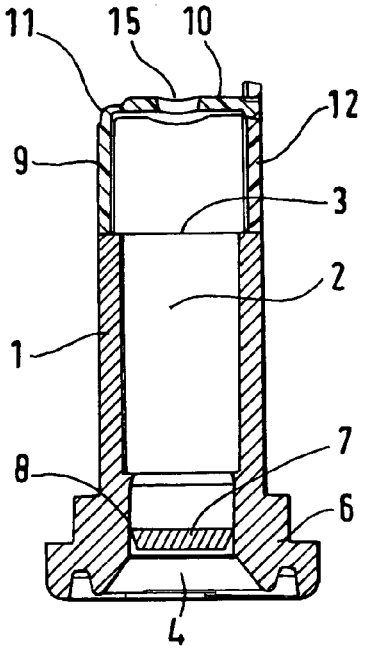
FIG. 3 is a view similar to FIG. 2 the distributor bar in a bridging over position thereof.
Figure 2:
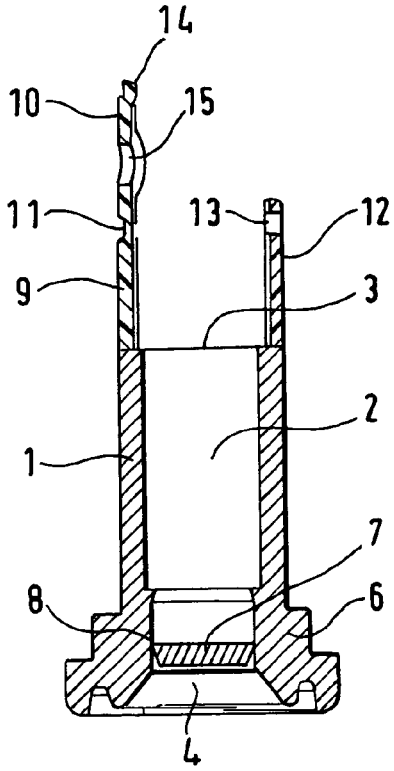
FIG. 2 is a sectional view along the section line II—II in FIG. 1 showing a distributor bar in a non-bridging position.

Through the base body 1 extends a through passage 2 which has opposite opening ends 3, 4 where the through passage 2 opens c.f. FIGS. 2 and 3. One opening end 3 of the through passage 2 faces the welding ribs 5 whilst the other opposite opening end 4 faces the mounting formation 6.

A barrier wall 7 for hermetically sealing the through passage 2 is provided at a suitable intermediate position of the through passage 2, preferably near the one opening end 4 thereof and extends transversely across the through passage 2, so as to prevent fluid flowing between the opening ends 3, 4 when the barrier wall 7 is in its intact state. The barrier wall 7 is integrally connected to the inner surface of the base body 1 by means of a weakened portion 8 which may be formed in the form of a peripherally extending thinning of the wall of the barrier wall 7. The weakened portion 8 is designed such that it can be caused to rupture in response to a sufficiently large external axial force exerted on the barrier wall 7 whereupon free passage for the fluid will be possible between the opening ends 3 and 4.

A pair of retaining bars 9, 12 each one projecting axially from the adjacent end face of the base body 1 and forming an axial extension thereof, is provided at diametrically opposite positions of the opening end 3 of the through passage 2. A transverse or distributor bar 10 is connected to the top end of one of the retaining bars 9, 12 by means of a hinged joint 11 in the form of a thinning of the wall of the said one retaining bar 9 and forms an axial extension of the retaining bar 9 in a position shown in FIG. 2 in which the distributor bar 10 is in a starting state. In the starting position of the distributor bar 10 shown in FIG. 2, a flow of fluid will emerge from the opening end 3 in the axial direction.

In the other retaining bar 12 opposite of the bar 9, a locking aperture 13 is provided, which can accommodate a nose 14 formed at the top end of the distributor bar 10 when the latter is pivoted into a position such as is shown in FIG. 3. In this position, the distributor bar 10 bridges over the opening end 3 of the through passage 2 in a spaced relationship therefrom. A flow of fluid emerging from the opening end 3 will therefore at least partially impinge upon the distributor bar 10 transversely extending across the through passage 2, thereby at least a portion of the flow of fluid will be deflected transversely.

An opening 15 may be provided centrally in the distributor bar 10 in order to allow a portion of the impinging flow of fluid to pass through axially even if the distributor bar 10 has been moved into the position wherein it bridges over the opening end 3 as shown in FIG. 3.

Forming the weld pourer member by injection moulding of a suitable plastic material is effected in the position of the distributor bar 10 shown in FIG. 2 in which it is not obstacle for introducing a moulding tool into the through passage 2. Consequently, a moulding tool for forming the barrier wall 7 can be moved through the through passage 2 up to the desired position of the barrier wall 7. The barrier wall 7 can thereby be formed simultaneously, thereby the complete weld pourer member can be formed in a single manufacturing step.

The distributor bar 10, either manually or by using a tool, can be pivoted against a material-induced inherent bias force exerted on the distributor bar 10 by the hinged joint 11 into the bridging over position shown in FIG. 3. This ensures secure retention of the nose 14 of the distributor bar 10 in the aperture 13 on the one hand, and automatic resilient return of the distributor bar 10 into the non-bridging position according to FIG. 2, or, the maintenance of this position after the nose 14 has been extracted from the aperture 13.

Rather than fixing the distributor bar 10 by means of a nose 14 engaging in the locking aperture 13, other suitable interlocking or friction type of engagement could be envisaged in order to fix the position of the distributor bar 10 relative to the retaining bar 12. Furthermore, instead of a single distributor bar, a pair of such bars e.g. in the form of a cross could be provided if so desired, in that a corresponding pair of retaining bars may be formed on the base body 1. Moreover, the expression "distributor bar" also includes a circular or rectangular impact plate which, in analogous manner to the distributor bars in the embodiment described hereinabove, can be hinged to one of the retaining bars and fixed in position relative to the other retaining bar. The retaining bars could also be replaced by a tubular retaining grating.

Although the invention has special advantages in connection with an integrally formed one-piece barrier wall, instead of this, a separately manufactured barrier wall of a foil material could also be provided, this barrier wall being adapted to be ruptured by a spike or the like and being fixed on the base body 1 by a welding or adhesive process in order to seal the through passage.

The above description of a preferred embodiment has been given by way of example. From the disclosure given, those skilled in the art will not only understand the present invention and the attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. A plastic insert member, including a base body containing a through passage, said through passage having opposite axial opening ends, connecting means for connecting said plastic insert member to a container member, and distributor means formed on the base body adjacent one of the axial opening ends of the through passage in spaced relationship therefrom for deflecting at least a portion of a flow of fluid emerging from said one opening end, said distributor means being movable between a position in which it extends across said one opening end of the through passage and a position in which it does not extend across said one opening end of the through passage.

2. The plastic insert member according to claim 1, wherein said distributor means is biased into the position in which it does not extend across said one opening end of the through passage.

3. The plastic insert member according to claim 1, wherein said distributor means has opposite longitudinal ends, said distributor means at one of the longitudinal ends thereof being integrally connected by hinge means to retaining means formed on the base body without preventing free axial flow of the fluid emerging from said one opening end of the through passage.

4. The plastic insert member according to claim 3, wherein at the other longitudinal end said distributor means is adapted to engage with locking means provided on the retaining means for holding the distributor means in the position in which it does not extend across said one opening end of the through passage.

5. The plastic insert member according to claim 1, wherein said distributor means has a central opening permitting axial through flow of a portion of the fluid emerging from said opening end of the through passage.

6. The plastic insert member according to claim 1, wherein said distributor means comprise at least a single distributor bar.

7. The plastic insert member according to claim 3, wherein said retaining means comprise at least a pair of retaining bars axially extending from an adjacent end face of the base body in diametrical relationship to the through passage.

8. The plastic insert member according to claim 1, and further including a barrier wall means extending across the through passage at an axial portion thereof intermediate the axial opening ends thereof.

9. The plastic insert member according to claim 8, wherein said barrier wall means is integrally connected with the base body through weakening means adapted to rupture under an axial force exerted thereon.

10. The plastic insert member according to claim 1, and formed as a weld pourer member comprising at least a single welding rib for welding said insert member to the container member.

* * * * *